United States Patent [19]

Sashida et al.

[11] 4,414,436

[45] Nov. 8, 1983

[54] NARROW-FREQUENCY BAND ACOUSTIC TRANSDUCER

[75] Inventors: Iwao Sashida, Saitmaken; Tsutomu Haga, Yamagata, both of Japan

[73] Assignee: Pioneer Speaker Components, Inc., Arlington Heights, Ill.

[21] Appl. No.: 369,589

[22] Filed: Apr. 19, 1982

[51] Int. Cl.[3] ..... H04R 17/00

[52] U.S. Cl. ..... 179/110 A; 179/121 R; 179/138; 179/139; 179/181 R

[58] Field of Search ..... 179/110 A, 121 R, 138, 179/139, 115 R, 181 R

[56] References Cited

U.S. PATENT DOCUMENTS

| | | | |
|---|---|---|---|
| 3,230,319 | 1/1966 | Kliewer | 179/181 R |
| 3,786,202 | 1/1974 | Schafft | 179/110 A |
| 4,190,784 | 2/1980 | Massa | 179/110 A |

*Primary Examiner*—G. Z. Rubinson
*Assistant Examiner*—Danita R. Byrd
*Attorney, Agent, or Firm*—Richard P. Crowley

[57] ABSTRACT

A narrow-frequency band, acoustic transducer of high conversion efficiency over a narrow-frequency band, which transducer comprises: a truncated diaphragm having a depressed, circular area and a peripheral edge about the circular area and a convex cap section extending outwardly from the circular area; a vibration board adhesively secured about the peripheral edge of the diaphragm, to couple acoustically the vibration board to the diaphragm on one side; and a piezoelectric element centrally secured to the other side of the vibration board, with electrical leads to the piezoelectric element, whereby electrical energy input to the piezoelectric element provides a high decibel acoustical output about the natural resonance frequency of the vibration board.

16 Claims, 2 Drawing Figures

NARROW-FREQUENCY BAND ACOUSTIC TRANSDUCER

BACKGROUND OF THE INVENTION

There are a wide number of acoustical transducers which provide for the conversion of energy between electrical and mechanical stimuli and which include the employment of a piezoelectric element to operate in a planar mode, particularly to provide for the conversion of electric energy to acoustical energy over a wide range of frequencies, such as in a high-frequency speaker. One such high-frequency transducer is described in U.S. Pat. No. 3,548,116, wherein a piezoelectric annular wafer is adhesively and directly mounted at the apex of a compliant diaphragm, with the diaphragm providing the sole support for the piezoelectric element, whereby the mass of the piezoelectric wafer assembly provides inertia for the operation of the transducer.

In another high-frequency, acoustical transducer, such as that described in U.S. Pat. No. 3,786,202, the transducer comprises a piezoelectric element secured to a truncated apex area of a diaphragm, the area defining a circular area, the diameter of which is less than the diameter of the first overtone node of the piezoelectric wafer, and wherein the piezoelectric wafer is directly secured within the circular area of the resilient diaphragm. In addition, a rubber damping disc is affixed at the opposite surface of the piezoelectric wafer, to lower the fundamental resonance frequency and to damp the peak output of the fundamental and first overtone resonance frequencies, thereby providing a flat frequency response over a desired band width.

It is desirable to provide a narrow-frequency band, acoustical transducer having a high conversion efficiency over the narrow band of frequency; for example, for use as a sound-emitting beeper device.

SUMMARY OF THE INVENTION

The invention relates to an acoustic transducer of high conversion efficiency and particularly to an acoustical transducer having a narrow band of frequency, to function as a relatively pure-tone, beeper-type device.

The invention concerns an acoustical transducer which can convert electrical signals to mechanical vibrations and vice versa employing a piezoelectric element, typically a monomorph, secured to a vibration board having a natural resonance frequency which is desired to be employed in the device. The acoustic transducer also includes a compliant, movable, radiating diaphragm characterized by a truncated area. The generally conical-shaped radiating diaphragm, such as a compliant paper, has a truncated section which is characterized by a generally circular (but may be elliptical or other shape), central open or depressed area which defines a narrow circumferential edge about the periphery of the truncated section of the diaphragm, and includes, as an integral or as a separately secured material, a convex cap element which extends over the depressed area of the truncated diaphragm. The transducer preferentially also has an additional, separate, generally parallel, spaced-apart, outer cap element of a different material from the diaphragm.

The vibration board, typically of a thin, flat, metal sheet, such as brass or a heat-conductive material, but which may be of other materials, such as plastic, acts as a resonating coupler. The vibration board on the one side is secured typically by an adhesive resin, such as an epoxy or other curable resin, solely to the narrow circumferential edge about the periphery of the truncated section of the diaphragm. The vibration board is generally, but need not be, circular, having a greater diameter than the truncated area of the diaphragm, but less than the diameter of the outer periphery of the diaphragm. The piezoelectric element, which may comprise a monomorph or a wafer assembly, such as a bimorph or polymorph, is secured by a resin centrally on the other side of the vibration board. Generally, the piezoelectric element is circular in nature and is centrally positioned on the other, opposite side of the vibration board. The electrical lead lines to the piezoelectric crystal are used as input or output terminals.

The vibration board, typically a circular, thin, such as 2 to 40 mils; for example, 5 to 20 mils, flat, resonating, sheet material, provides a support for the piezoelectric element, and, where the vibration board is composed of a metal, the vibration board acts as a heat conductor, to dissipate heat generated during the operation of the acoustical transducer. The vibration board also serves as a resonant coupler to the compliant diaphragm on the one side through the peripheral edge by which the vibration board is secured adhesively to the diaphragm, and also acts as a resonant coupler to the cap element within the circular area of the diaphragm on the one side, while acting as a resonant coupler receiving acoustical signals on the other side from the supported piezoelectric element. Thus, the vibration board provides for a support mechanism, as well as providing a source of a narrow-band, natural-resonance frequency of the vibration board to be emitted in the acoustical transducer. The acoustical transducer has the advantage of having a very high conversion efficiency over a narrow band of frequency.

Typically, standard sounder or beeper-tone-type devices exhibit a much lower acoustical output than does the device of the invention. It has been found that the measured differences in output in the peak efficiency of the device of the invention often range from about 20 decibels or more, or an increase of over 100-fold. Significant efficiency increase is noted over the frequency range of about 2.5 to 20 kilohertz; for example, 8 to 12 kilohertz, with the increase ranging from about 5 to 30 decibels or more.

The vibration board may be made of a variety of materials, and the output at resonance is controlled in level and band width by using a vibration board of a selected material, such as of a metal or a nonmetal, typically a polymer, such as nylon, polypropylene, polyethylene, polycarbonate or other materials having a desired natural resonance frequency when subjected to mechanical stimuli. Both the piezoelectric element and the vibration board are preferably circular; however, the vibration board and the piezoelectric element may be employed in a variety of shapes, such as square, rectangular, oval or polyhedral, but preferentially the shape of the vibration board and the piezoelectric crystal should be the same or similar.

The piezoelectric element may comprise a monomorph or a wafer assembly, such as a bimorph, as desired. The radiating compliant diaphragm is preferably conical and, therefore, exhibits a circular, convex, depressed area or an open area. However, it is recognized that the open area may assume other shapes, such as the shape of an ellipse.

In one embodiment, an inner, convex, cap element is integral with the diaphragm. An outer, convex-type cap element is employed and is attached over the depressed area of the truncated diaphragm and is coupled to the diaphragm by the use of an adhesive resin about the periphery and is secured to the circumferential edge of the truncated section of the diaphragm. The cap element may be composed of a different material from the diaphragm, typically a thin, convex, plastic, dome-type cap material, such as of plastic like a polyester, or may be composed of the same material as the diaphragm. Generally, the outer cap element is dome-like in shape and is composed of a thin plastic material and may have an outer metallized coating for ornamental or appearance purposes.

In manufacture, a dome-like cone of a compliant material, such as paper, is used and the top of the dome is depressed inwardly a desired distance, to form the depressed dome-like area of the truncated cone, with a thin edge area generally circular about the depressed area. The integral, depressed dome of the cone forms the inner cap element of the transducer. A thin, outer, dome cap element of a compliant plastic material is then placed over the inner cap element, with the circumferential edge secured by adhesive to the diaphragm, to couple the outer dome to the diaphragm. Preferably, the outer dome element is spaced apart a short distance 1/16th to ¼ of an inch from the outer surface of the inner cap element, with the inner surface of the outer cap element generally parallel to the outer surface of the inner cap element; that is, has the same general shape or curvature. If desired, the inner cap element may be omitted; however, this would require the additional operation of removing the inner portion of the depressed area. In such a case, the outer cap element would be secured as before about its periphery over the open truncated area and to the inner portion of the diaphragm.

In the acoustical transducer of the invention, a narrow frequency, representing a substantially pure tone, is emitted, which narrow-frequency band is about the natural resonance frequency of the vibration board, except as it is enhanced in output. The acoustical transducer of the invention may be employed as a sound-emitting beeper device, particularly where a pure tone, high-volume device is required, to attract the beeper user's attention; for example, in areas of high background noise or hard-to-hear locations, such as sporting events, industrial sites, or where immediate attention is desired. Typically, the nodes of the first overtone of the piezoelectric wafer element employed are smaller than the diameter of the truncated area of the radiating diaphragm. The first overtone, for example, of a thin brass sheet used as a vibration board, is larger than the diameter of the area. Thus, the vibration board generally has a single vibration frequency and is acoustically coupled, to drive the truncated diaphragm and to provide a high-decible, narrow-frequency output, which output is enhanced by coupling to an outer cap element, so that the band output emitted exists around the fundamental resonance of the vibration board. In the device as described there is no direct contact of the diaphragm with the piezoelectric element, with the only direct coupling occurring solely along the peripheral circumferential line of the truncated diaphragm and the selected, flat, circular vibration board on the one side, while the piezoelectric element is centrally secured to the vibration board on the opposite side.

The invention will be described for the purpose of illustration only in connection with a particular embodiment; however, it is recognized that various changes, additions, modifications and improvements may be made to the illustrated embodiment, all falling within the spirit and scope of the invention.

DESCRIPTION OF THE EMBODIMENTS

Figure 1:
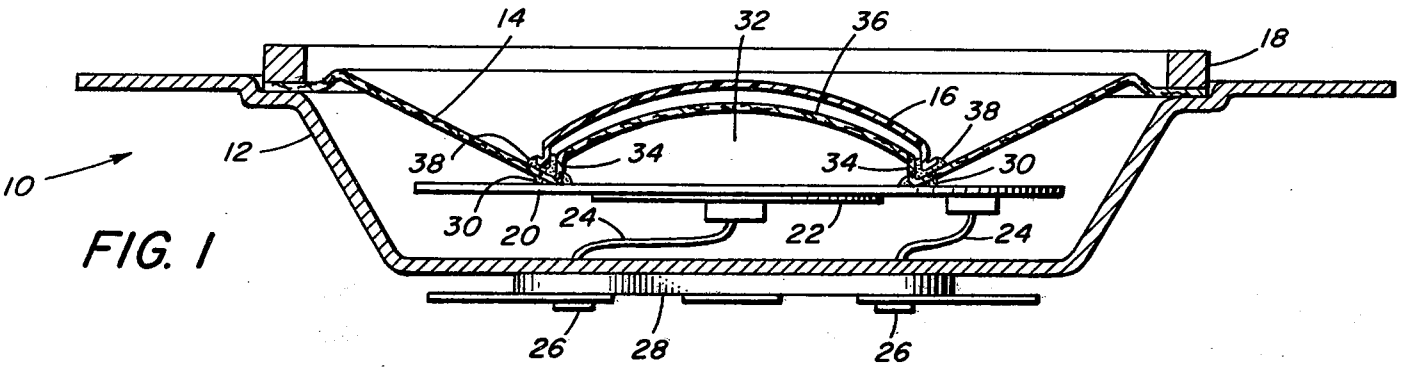
FIG. 1 is a schematic, cross-sectional view of the acoustical transducer of the invention.

FIG. 1 shows an acoustical transducer 10 of the invention, having a dish-like, stamped, metal frame 12 and a compliant, semirigid, paper, conical, radiating diaphragm 14 whose outer peripheral edge is secured to the stamped frame 12 through the employment of a gasket 18. An outer, dome-like cap element 16 composed of a plastic, such as Mylar (a trademark of E. I. du Pont de Nemours Co.), a rigid polyester resin having a thin, outer, shiny, metallized coating, is secured to the peripheral edge 34 of the truncated section of the diaphragm 14. The device includes a circular, thin, flat, metal vibration board element 20, such as of brass, having a natural resonance frequency of about 9.5 to 10.5 kilohertz. On the opposite side of the vibration board 20 is a monomorph piezoelectric element 22 having a generally flat surface and being circular in shape and centrally secured to the vibration board 20, such as by the use of an adhesive resin like an epoxy resin. Electrical input and output lead wires 24 are shown from the piezoelectric element 22 in the vibration board 20, to provide for the input or the output of electrical energy from input and output plug terminals 26 of the lead wires 24 secured to an electrically insulating sheet material 28 on the opposite side and bottom of the frame 12. The vibration board 20 is secured solely by a thin, circumferential line of adhesive material, such as by an epoxy resin 30, about the circumference of the depressed area 32 of the truncated diaphragm 14 and to the peripheral edge 34 of the diaphragm. An inner, dome cap element 36 is integral with and is formed by the depressed section of the diaphragm 14. The outer dome cap element 16 is coupled for resonance by an adhesive 38 about the generally inner section of the truncated radiating diaphragm 14, to enhance the acoustical output of the radiating diaphragm 14, which radiating diaphragm 14 is acoustically coupled with the vibration board 20.

In the operation of the acoustical transducer, as shown in FIG. 1, electrical energy is supplied through the input terminal 26 and through electrical lead line 24 to the monomorph piezoelectric element 22, to drive the circular piezoelectric element in a planar-bending mode, thereby imparting centrally outwardly extending mechanical stimuli to the vibration board 20 which is resonantly coupled through the peripheral ring of adhesive 30, about the peripheral edge 34 to the truncated radiating diaphragm 14, and which diaphragm is coupled to the cap elements 36 and 16 for enhanced acoustical output. The mechanical stimuli from the piezoelectric element 22 radiate outwardly and circularly to the peripheral circumferential contacting edge 34 through the vibration board 20 and to the radiating diaphragm 14, to provide an acoustical output which is then enhanced through the movement of the inner and outer cap elements 16 and 36.

Figure 2:
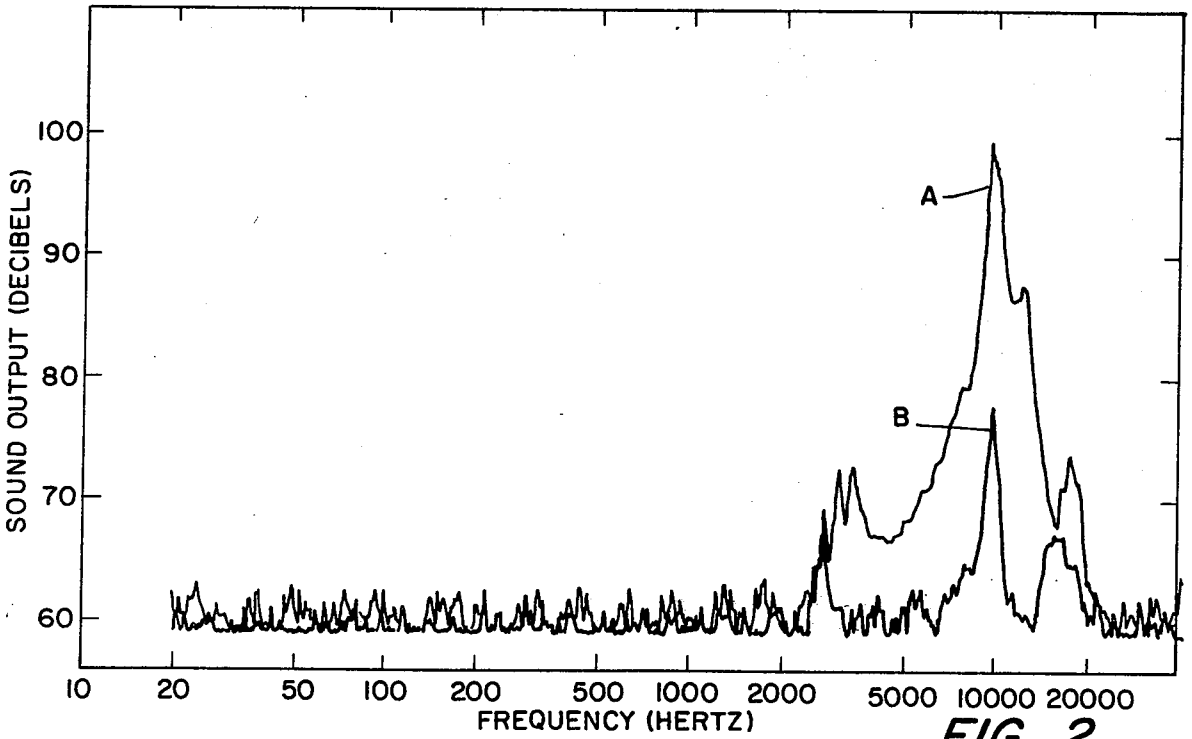
FIG. 2 is a graphical representation of the sound output versus the frequency response of the acoustical transducer of FIG. 1, in comparison to the device of FIG. 1 without a radiating diaphragm and cap.

FIG. 2 is a graphical illustration of the acoustical transducer of FIG. 1. The transducer represents about a 2-inch tweeter having a nominal sensitivity value of about 94 to 96 decibels at a peak value of 2.8 volts, with a power rating of about 3 watts. A comparative test was carried out to determine the frequency response, with reference to 2.83 volts electrical input with a microphone at 0.5 meters distance. The frequency response was carried out with a transducer with the radiating diaphragm 14 and cap elements 16 and 36 (A) and without the radiating diaphragm or cap elements (B). As illustrated in FIG. 2, there is a considerably enhanced decibel output at the peak resonance frequency of about 10 kilohertz, increasing from about less than 80 to almost 100, representing an increase of 20 decibels or about 100-fold; thus, illustrating the high conversion efficiency of the narrow-band, acoustical transducer of the invention.

What is claimed is:

1. An acoustical transducer for conversion of energy between mechanical and electrical stimuli, to provide for the high conversion efficiency of a narrow-frequency band, which transducer comprises in combination:

(a) a conical-shaped, radiating, resonating diaphragm having a truncated area characterized by a depressed central area, to present a thin, circumferential, edge area about the truncated area of the diaphragm;

(b) a convex-shaped cap element extending over the truncated area and having an outer peripheral edge acoustically coupled generally about the circumferential edge area of the diaphragm;

(c) a piezoelectric element having a generally flat major surface and adapted to be driven in a planar mode by electrical energy;

(d) a thin vibration board having a natural resonance frequency within the narrow-frequency band and having a general diameter greater than the diameter of the truncated area of the diaphragm and less than the outer diameter of the diaphragm;

(e) adhesive means to secure the circumferential edge area of the diaphragm to the one side of the vibration board and generally centrally positioned thereof;

(f) means to secure the piezoelectric element to the other side of the vibration board and generally centrally of the vibration board and of the diaphragm; and (g) electrical communication means to the piezoelectric element, whereby, on the electrical energizing of the piezoelectric element, the vibration board, acoustically coupled to the circumferential edge area of the diaphragm, and the diaphragm, circumferentially coupled to the cap element, provide for the high decibel output of a narrow-frequency band about the natural resonance frequency of the vibration board.

2. The transducer of claim 1 wherein the vibration board comprises a circular shape.

3. The transducer of claim 1 wherein the vibration board comprises a thin, heat-conductive metal.

4. The transducer of claim 1 wherein the vibration board comprises a thin, rigid, plastic sheet material.

5. The transducer of claim 1 wherein the vibration board comprises a thickness from about 2 to 40 mils.

6. The transducer of claim 1 wherein the vibration board is circular-shaped and the piezoelectric element is circular-shaped and centrally positioned on the one side of the circular-shaped vibration board.

7. The transducer of claim 1 wherein the convex cap element comprises a dome-shaped element composed of a plastic material.

8. The transducer of claim 1 wherein the piezoelectric element is adhesively secured to the other side of the vibration board.

9. The transducer of claim 1 wherein the cap element is composed of the same material and is an integral part of the radiating diaphragm.

10. The transducer of claim 1 which includes an inner, dome-like, convex cap element composed of the same material as the diaphragm and being an integral part of the diaphragm, and an outer, dome-like cap element of the same general shape as the inner cap element and spaced slightly apart therefrom, the peripheral edge of the outer cap element secured and coupled by adhesive means to the inner portion of the diaphragm.

11. The transducer of claim 10 wherein the inner cap element and the radiating diaphragm are composed of a compliant paper material, and the outer cap element is composed of a compliant plastic material.

12. The transducer of claim 1 wherein the truncated area of the radiating diaphragm is generally circular in shape.

13. The transducer of claim 1 wherein the natural resonance frequency of the vibration board ranges from about 9.5 to 10.5 kilohertz.

14. The transducer of claim 1 wherein the acoustical transducer has a sound output of greater than about 90 decibels, with an input voltage of about 2.8 volts, to provide a narrow-frequency band of from about 9.5 to 10.5 kilohertz.

15. The transducer of claim 1 wherein the piezoelectric element is a monomorph element.

16. An acoustical transducer for conversion of energy between mechanical and electrical stimuli, to provide for the high conversion efficiency of a narrow-frequency band, which transducer comprises in combination:

(a) a dish-like frame element;

(b) a conical-shaped, radiating, resonating diaphragm secured within the frame element, the diaphragm characterized by a generally circular, central, depressed area, to provide (i) a thin, circumferential edge area about the truncated area, and (ii) an inner, convex, dome-like cap element integral with and composed of the material of the diaphragm;

(c) an outer, convex, dome-like cap element of the same general shape as the inner cap element and spaced slightly apart therefrom, the peripheral edge of the outer cap element coupled by adhesive means to the inner portion of the radiating diaphragm, the outer cap element composed of a plastic material;

(d) a generally circular, monomorph, piezoelectric element having a generally flat major surface and adapted to be driven in a planar mode by electrical energy;

(e) a thin, generally circular, heat-conductive, metal vibration board having a natural resonance frequency of from about 0.5 to 20 kilohertz and having a diameter greater than the diameter of the circular truncated area, but less than the outer diameter of the diaphragm;

(f) first adhesive means to secure the circumferential edge area of the diaphgram to one side of the vibration board and generally centrally thereof;

(g) second adhesive means to secure the piezoelectric element to the other side of the vibration board and generally centrally thereof;

(h) third adhesive means to secure and to couple the peripheral edge of the outer cap element to the inner portion of the radiating diaphragm generally about the thin circumferential edge area;

(i) an electrical insulating material secured to the outer surface of the frame element;

(j) input/output terminals on the insulating material; and (k) electrical leads from the piezoelectric element to the terminals, whereby, on electrical energy of the piezoelectric element, a high decibel output of a narrow-frequency band about the natural resonance frequency of the vibration board is emitted.

* * * * *